US011274032B1

(12) United States Patent
Sima

(10) Patent No.: US 11,274,032 B1
(45) Date of Patent: Mar. 15, 2022

(54) TELESCOPIC-TYPE HORSEWHIP WITH POSITIONABLE AND ADJUSTABLE LENGTH

(71) Applicant: ZHENJIANG ANGEL EQUESTRIAN PRODUCTS CO., LTD., Jiangsu (CN)

(72) Inventor: Ping Sima, Jiangsu (CN)

(73) Assignee: Zhenjiang Angel Equestrian Products Co., Ltd., Jiangsu (CN)

( * ) Notice: Subject to any disclaimer, the term of this patent is extended or adjusted under 35 U.S.C. 154(b) by 0 days.

(21) Appl. No.: 17/112,626

(22) Filed: Dec. 4, 2020

(30) Foreign Application Priority Data

Aug. 24, 2020 (CN) ..... 202021784456.9

(51) Int. Cl.
*B68B 11/00* (2006.01)

(52) U.S. Cl.
CPC ..... *B68B 11/00* (2013.01)

(58) Field of Classification Search
CPC ..... B68B 11/00; F16B 7/142; F41B 15/025; F41B 15/027; A45B 2009/007; A45B 19/04; A47L 13/00; B25G 1/04
See application file for complete search history.

(56) References Cited

U.S. PATENT DOCUMENTS 4,863,095 A * 9/1989 Crane ..... B68B 11/00 231/2.1
7,525,786 B1 * 4/2009 Douglas ..... F41B 15/04 361/232

* cited by examiner

*Primary Examiner* — Joshua J Michener
*Assistant Examiner* — Henry Hooper Mudd
(74) *Attorney, Agent, or Firm* — Inskeep IP Group, Inc.

(57) ABSTRACT

Disclosed is a telescopic-type horsewhip with a positionable and adjustable length, including a hollow whip rod grip section, a hollow whip rod extension section, and hollow whip rod sections. One end of the hollow whip rod extension section is arranged in the hollow whip rod grip section, and the other end of the hollow whip rod extension section is connected with the hollow whip rod section. A whip popper, a whip flap, a whip lash, a whip lash connector or a detachable whip drop lash fixing set is provided at an end of the hollow whip rod section. The hollow whip rod extension section and the hollow whip rod grip section are connected by a locking bolt. The hollow whip rod grip section, equipped with a tail cover on its other end, is provided with a non-slip handle at one end near the tail cover.

6 Claims, 10 Drawing Sheets

TELESCOPIC-TYPE HORSEWHIP WITH POSITIONABLE AND ADJUSTABLE LENGTH

RELATED APPLICATIONS

This application claims priority to Chinese Patent Application No. 202021784456.9, filed Aug. 24, 2020, which is hereby incorporated herein by reference in its entirety.

TECHNICAL FIELD

The present disclosure relates to the field of horse-riding equipment, more particularly, to a telescopic-type horsewhip with a positionable and adjustable length.

BACKGROUND OF THE INVENTION

Currently, although equestrian sports are more popular in Europe and America, a certain number of people in China also engage in and love the sports. At present, most of the horsewhips used in equestrian sports and horse training are of fixed size. However, the existing telescopic-type horsewhips have no positionable length or have positionable length but are still very long after being retracted, which is not convenient for mailing, carrying and storage. When doing equestrian sports, due to different heights of horses or different sizes of venues during training, people need to be equipped with horsewhips of different lengths in order to achieve the best distance between man and horse to better guide the horse. At the same time, most of the existing horsewhips are inconvenient for e-commerce practitioners to deliver horsewhips to consumers with lower packaging and shipping costs.

SUMMARY

The purpose of the present disclosure is to provide a horsewhip that is light and comfortable, firm in structure, and short in length with less than 68 cm after being retracted, which is convenient to transport, mail, carry and store, and can be positioned in several different lengths after stretching, thus solving the shortcomings of the existing technology.

To solve the above technical problems, the present disclosure adopts the following technical solutions:

A telescopic-type horsewhip with a positionable and adjustable length, including: a hollow whip rod grip section, a hollow whip rod extension section, and one or more hollow whip rod, wherein the one or more hollow whip rod sections, which sequentially connected with each other in a socketed manner, are connected to the hollow whip rod extension section in a socketed manner, wherein one end of the hollow whip rod extension section is arranged in the hollow whip rod grip section, and the other end of the hollow whip rod extension section is connected with the hollow whip rod section. And one of a whip popper, a whip flap, a whip lash, a whip lash connector or a detachable whip drop lash fixing set is provided at an end of the hollow whip rod section;

wherein, an inner diameter of the hollow whip rod grip section is consistent in size. The hollow whip rod extension section is fixedly provided with a positioner at an end of an inner end of the hollow whip rod grip section. An outer diameter of the positioner is greater than an outer diameter of the hollow whip rod extension section and less than or equal to the inner diameter of the hollow whip rod grip section. The hollow whip rod grip section is provided with a locking bolt at a connecting part with the hollow whip rod extension section. The locking bolt is arranged at one end of the hollow whip rod grip section, and the locking bolt includes a locking ring fixing bolt, a locking ring and a locking nut;

wherein, one end of the locking ring fixing bolt is fixedly arranged inside the hollow whip rod grip section. An inside of the other end of the locking ring fixing bolt is provided with a tongue-and-groove and connected with the locking ring. A tongue-and-groove matched with the tongue-and-groove inside the locking ring fixing bolt is provided at an outer ring of one end of the locking ring connected with the locking ring fixing bolt. The connecting part of the locking ring and the locking ring fixing bolt is provided with an adapted clamping groove. The locking nut is connected with the locking ring fixing bolt through a threaded thread opening. An outer diameter of one end of the locking ring is adapted to an inner diameter of the end of the locking nut, and a tail cover is provided at the other end of the hollow whip rod grip section.

Further, a length dimension of the hollow whip rod extension section of the horsewhip is larger than that of the hollow whip rod grip section of the horsewhip.

Furthermore, the hollow whip rod section is arranged in the hollow whip rod extension section, and a size of one end of the hollow whip rod section connected to the hollow whip rod extension section is larger than a size of the other end.

Furthermore, the hollow whip rod extension section is provided with a size scale bar.

Furthermore, the positioner provided at one end of the hollow whip rod extension section is provided with an air flow groove.

Furthermore, the hollow whip rod grip section is provided with a collar with a non-slip handle at one end near the tail cover.

Compared with the prior art, the beneficial effects of the present disclosure are:

the horsewhip of the present disclosure adopts a hollow whip rod, and a hollow whip rod extension section is arranged in the hollow whip rod grip section. One end of the hollow whip rod extension section is provided with a positioner, and the other end uses a locking bolt to lock the hollow whip rod extension section in the hollow whip rod. When in use, by adjusting the locking bolt, the length of the hollow whip rod extension section can be changed to meet the needs of users. The size scale bar on the hollow whip rod extension section allows users to adjust the length of the whip more conveniently, and the tip part of the hollow whip rod section can be equipped with different accessories to meet the needs of more users. The present disclosure has the advantages of convenient transportation, convenient storage, convenient carrying, firm structure, and has flexible length according to actual conditions during use.

1. hollow whip rod grip section,
2. locking ring fixing bolts,
3. locking ring,
4. non-slip handle,
5. locking nut,
6. tail cover,
7. collar,
8. whip popper,
9. whip lash,
10. hollow whip rod extension section,
11. positioner,
12. size scale bar,
13. whip lash connector,
14. hollow whip rod section,
15. whip flap,
16. air flow groove,
17. detachable arc-shaped whip popper,
18. detachable whip drop lash fixing set

DETAILED DESCRIPTION

The following describes the technical solution of the present disclosure clearly and completely in conjunction with the drawings in the embodiments of the present disclosure:

Embodiment 1

Figure 1:
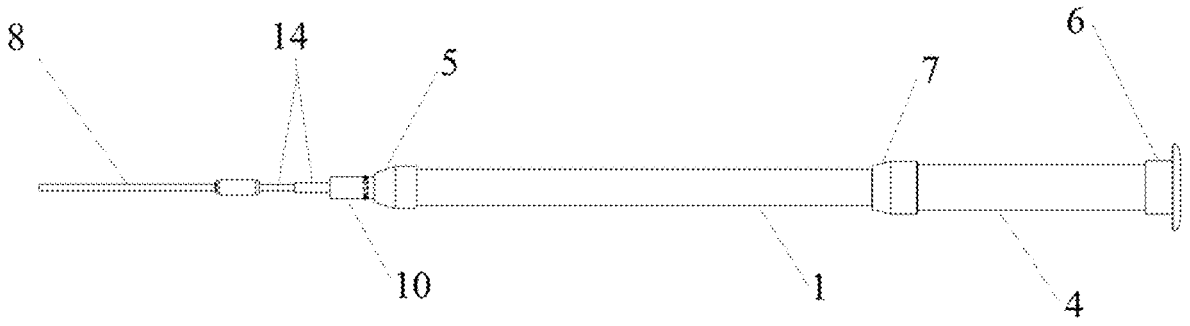
FIG. 1 is a schematic structural diagram of Embodiment 1 of the present disclosure.
Figure 2:
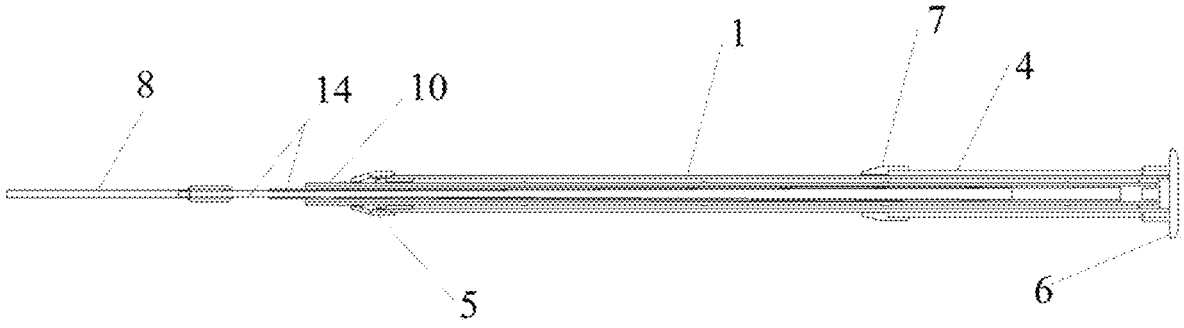
FIG. 2 is a schematic cross-sectional structure diagram of the present disclosure.
Figure 3:
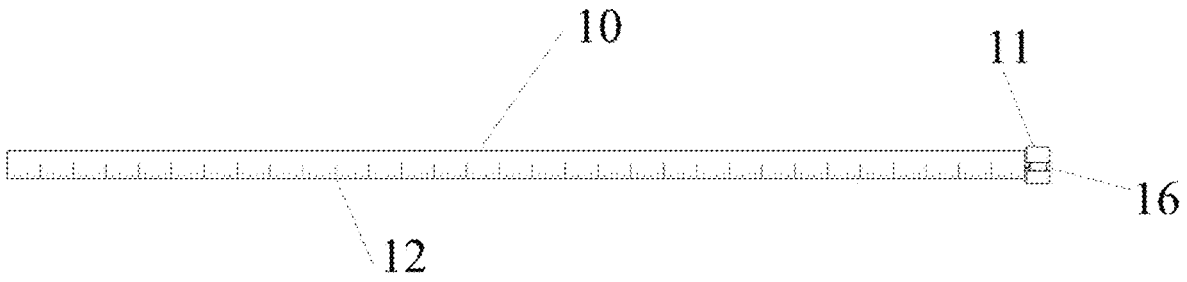
FIG. 3 is a detailed view of the hollow whip rod extension section of the present disclosure.
Figure 4:
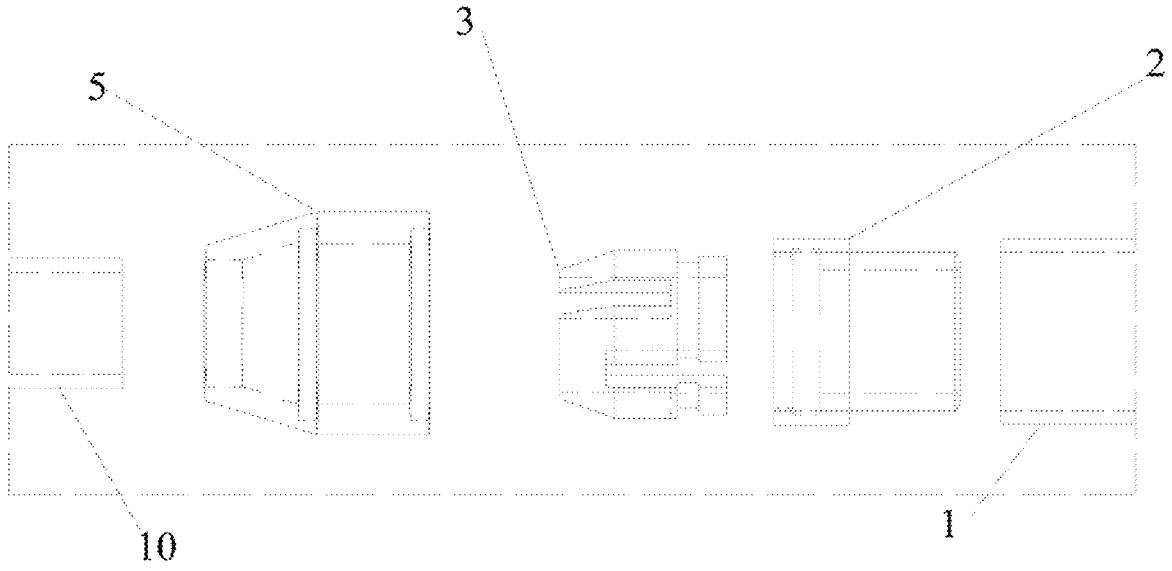
FIG. 4 is a detailed view of the locking bolt structure of the present disclosure.
Figure 5:
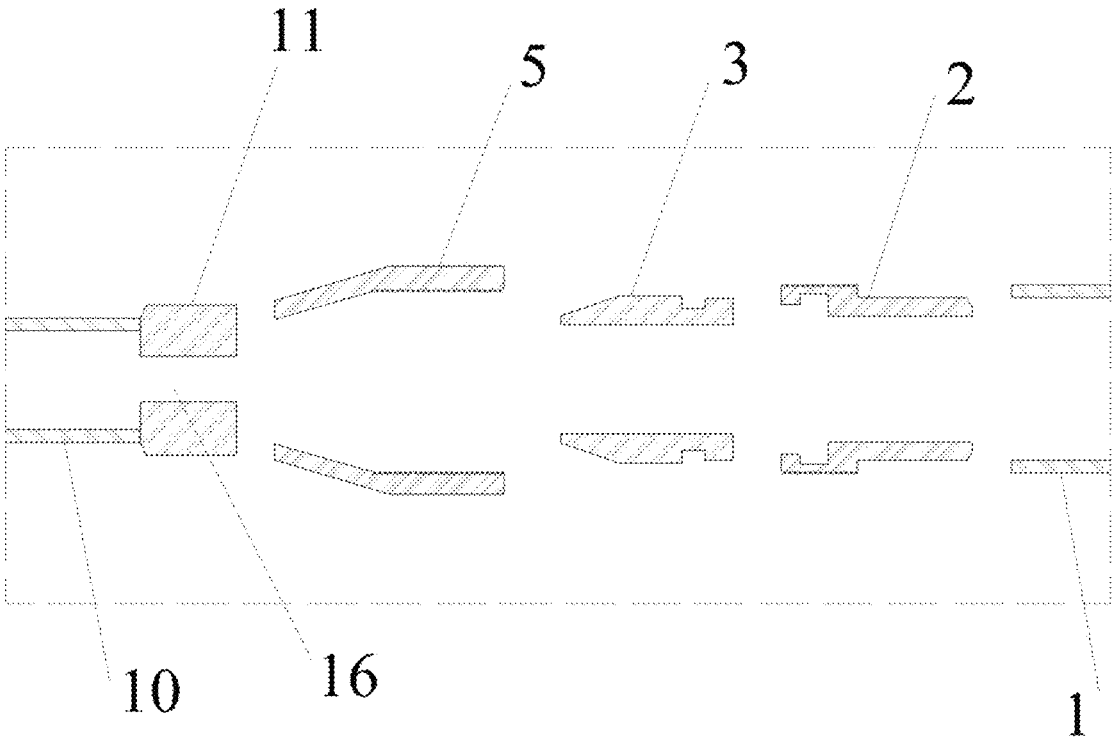
FIG. 5 is a detailed view of a sectional structure of the locking bolt of the present disclosure.
Figure 6:
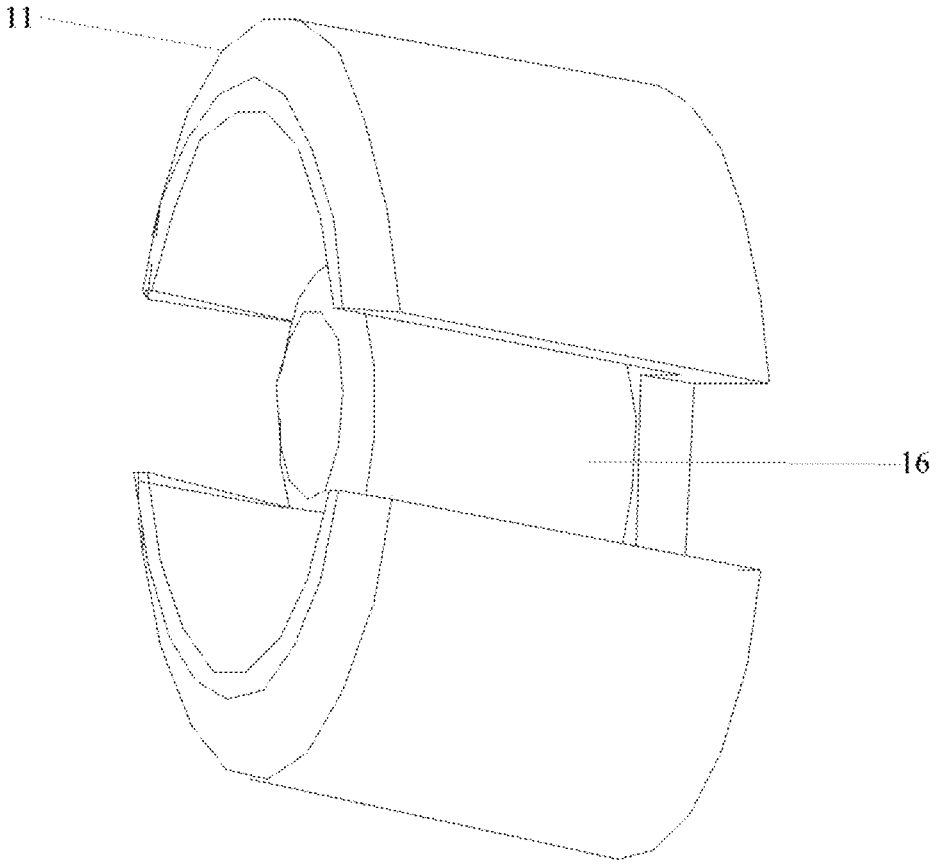
FIG. 6 is a detailed view of the positioner of the present disclosure.

Referring to FIGS. 1 to 6, a telescopic-type horsewhip with a positionable and adjustable length, which includes a hollow whip rod grip section 1, a hollow whip rod extension section 10, two hollow whip rod sections 14 and a whip popper 8. The hollow whip rod grip section 1 and the hollow whip rod extension section 10 are both internal hollow structures. An inner diameter size of an inner hollow mechanism of the hollow whip rod grip section 1 is consistent in size, the outer diameter of the hollow whip rod extension section 10 is consistent in size, and the inner diameter of the inner hollow mechanism of the hollow whip rod extension section 10 is large at one end and small at the other end which is convenient for socketing.

The outer diameter of the hollow whip rod extension section 10 is smaller than the inner diameter of the hollow whip rod grip section 1. One end of the hollow whip rod grip section 1 is inserted with the locking ring fixing bolt 2, one end of the locking ring fixing bolt 2 is adapted to the inner diameter size of the hollow whip rod grip section 1, and one end of the locking ring fixing bolt 2 is glued to the hollow whip rod grip section 1. The other end of the locking ring fixing bolt 2 is provided with an outer thread, and the inner ring is provided with a concave-convex tongue-and-groove. The other end of the locking ring fixing bolt 2 is inserted with the locking ring 3, and the insertion end of the locking ring 3 is provided with a concave-convex bayonet adapted to the inner ring of the locking ring fixing bolt 2. The locking ring 3 is provided with a number of parallel grooves consistent with its insertion direction. The locking ring 3 is pinched while inserting it into the locking ring fixing bolt 2, and screwing the locking nut 5 fitted with the inner thread onto the locking ring fixing bolt 2 through the outer thread set on the outer ring, and the inner diameter of one end of the locking nut 5 is matched with the outer diameter of one end of the locking ring 3.

A positioner 11 is fixedly installed at one end of the hollow whip rod extension section 10, and the outer diameter of the positioner 11 is larger than the outer diameter of the hollow whip rod extension section 10 and the inner diameter of the locking ring fixing bolt 2.

The other end of the hollow whip rod grip section 1 is provided with a non-slip handle 4 near the end. One end of the non-slip handle 4 is fixed on the hollow whip lever grip section 1 with a collar 7, and the other end of the non-slip handle 4 is provided with a tail cover 6 which presses the end of the non-slip handle 4 and simultaneously seals the end of the hollow whip rod grip section 1.

For facilitating the user to better determine the total length of the horsewhip when pulling out the hollow whip rod extension section 10, corresponding size scale bars 12 are evenly arranged on the outer ring of the hollow whip rod extension section 10, which is more conducive for the user to accurately know the length of the whip.

When assembling, firstly inserting one or more hollow whip rod sections 14 into the hollow whip rod extension section 10, and then installing and fixing the positioner 11 on one end of the hollow whip rod extension section 10, and inserting this end into the hollow whip rod grip section 1, inserting the locking ring 3 into the locking ring fixing bolt 2 and then sleeving it on the outside of the other end of the hollow whip rod extension section 10, and installing it on the hollow whip rod grip section 1, installing the non-slip handle 4, the collar 7, the tail cover 6 onto the hollow whip rod grip section 1, and finally installing a whip popper 8 onto the tip part of the hollow whip rod section 14 at the front end.

Or inserting the locking ring 3 into the locking ring fixing bolt 2 and then installing it on the hollow whip rod grip section 1, and then inserting one or more hollow whip rod sections 14 into the hollow whip rod extension section 10, then installing and fixing the positioner 11 on the insertion end of the hollow whip rod extension section 10, inserting the other end of the hollow whip rod extension section 10 from the tail of the hollow whip rod grip section 1 through the locking ring 3, installing the non-slip handle 4, the collar 7, the tail cover 6 on the hollow whip rod grip section 1, and finally installing the whip popper 8 onto the tip part of the hollow whip rod section 14 at the front end.

Embodiment 2

Figure 7:
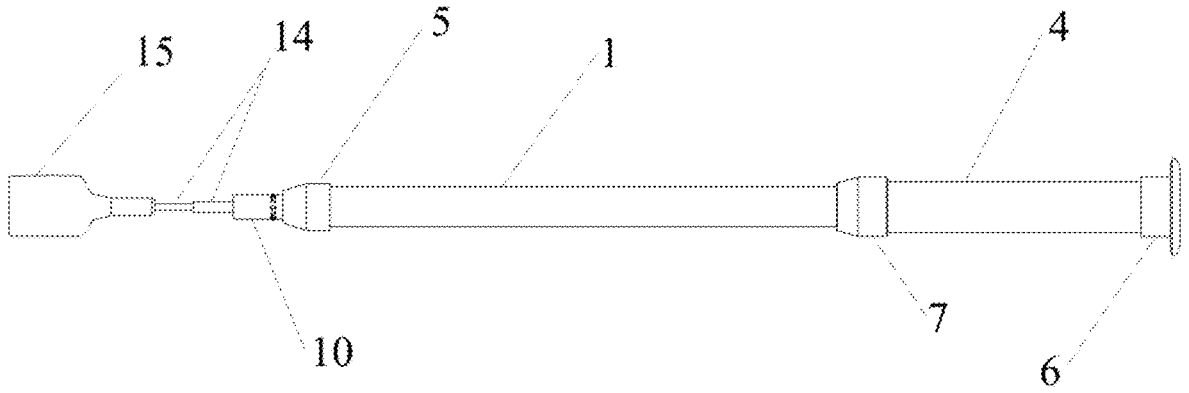
FIG. 7 is a schematic structural diagram of Embodiment 2 of the present disclosure.

Referring to FIGS. 2-7, the difference between this embodiment and Embodiment 1 is that in this embodiment, the end of the hollow whip rod section 14 at the end of the horsewhip is fixedly provided with the whip flap 15 by means of glue or rope, which is suitable for different environments and thereby meeting the needs of users.

Embodiment 3

Figure 8:
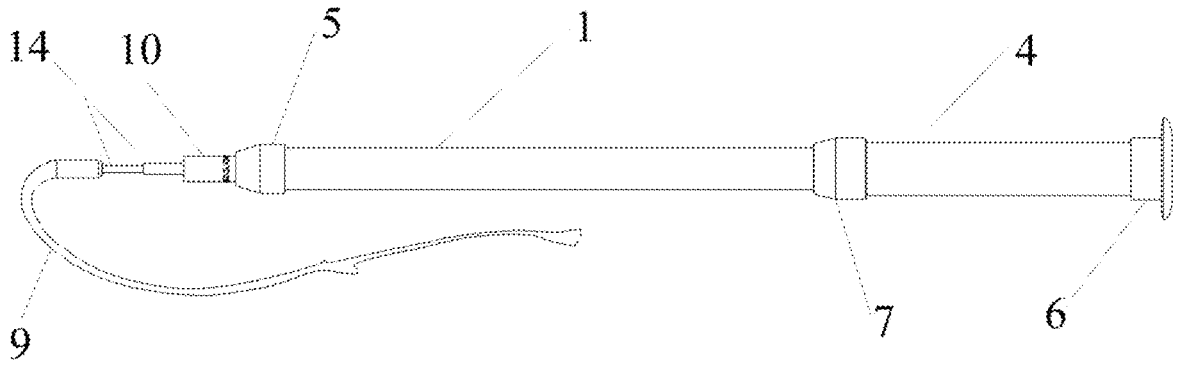
FIG. 8 is a schematic structural diagram of Embodiment 3 of the present disclosure.

Referring to FIGS. 2-6 and 8, the difference between this embodiment and Embodiment 1 is that in this embodiment, the whip lash 9 is fixedly provided at the end of the hollow whip rod section 14 at the end of the horsewhip by means of glue or rope, which is suitable for different environments and thereby meeting the needs of users.

Embodiment 4

Figure 9:
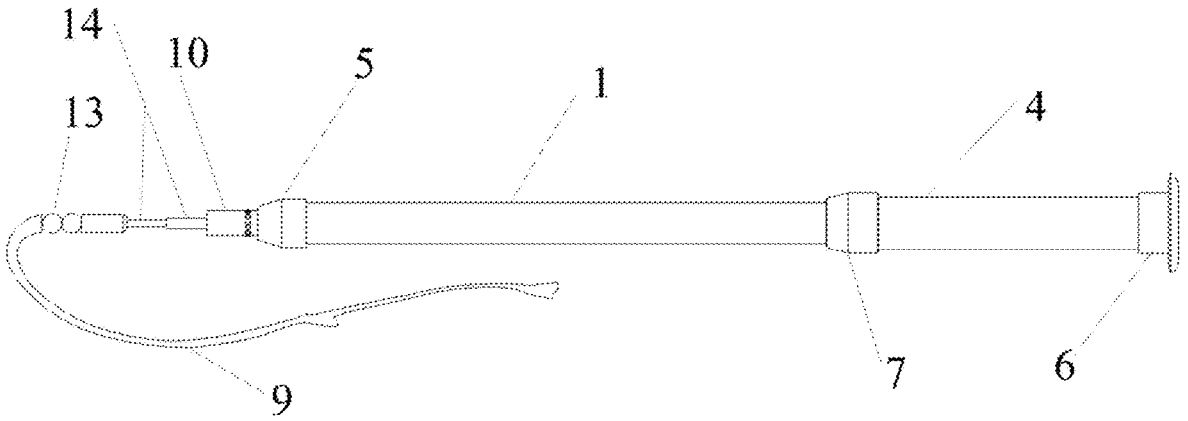
FIG. 9 is a schematic structural diagram of Embodiment 4 of the present disclosure.

Referring to FIGS. 2-6 and 9, the difference between this embodiment and Embodiment 1 is that in this embodiment, the whip lash connector 13 is fixedly provided at the end of the hollow whip rod section 14 at the end of the horsewhip by means of glue or rope, which is suitable for different environments and thereby meeting the needs of users.

Embodiment 5

Figure 10:
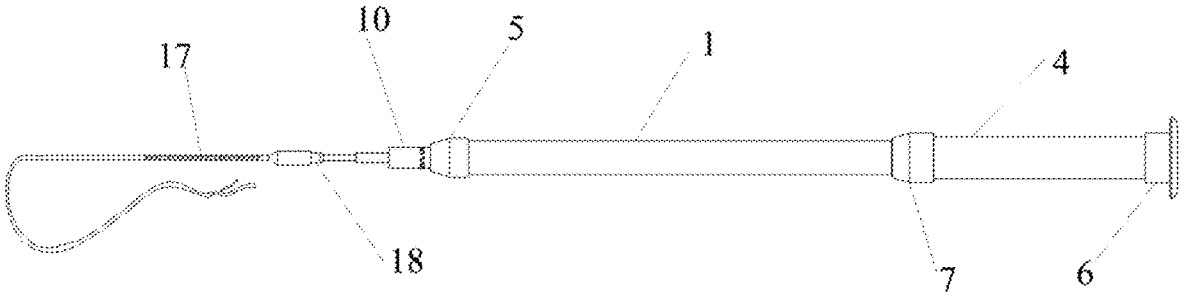
FIG. 10 is a schematic diagram of the structure of Embodiment 5 of the present disclosure.

Referring to FIGS. 2 to 6, and 10, the difference between this embodiment and Embodiment 1 is that in this embodiment, the hollow whip rod section 14 at the end of the horse whip is provided with a detachable whip drop lash fixing set 18 to install a detachable arc-shaped whip popper 17, and the detachable whip drop lash fixing set 18 and the detachable arc-shaped whip popper 17 are connected by screwing or clamping such that users can firmly combine or separate the detachable arc-shaped whip popper 17 with the whip rod through the detachable whip drop lash fixing set 18 according to their own needs, which is suitable for different environments and thereby meeting more needs of users.

When using the horsewhip in the above embodiments of the present disclosure, only the locking nut 5 needs to be loosened, the locking ring 3 is loosened and the clamped hollow whip rod extension section 10 is released, at this point, users can easily pull the hollow whip rod extension section 10, then determine the appropriate length according to the size scale bar arranged on the hollow whip rod extension section 10, and then screw the locking nut 5 to shrink the locking ring 3 to clamp the hollow whip rod extension section 10 to fix the total length of the whip.

The basic principles, main features and advantages of the present invention are shown and described above. Those skilled in the industry should understand that the present disclosure is not limited by the above-mentioned embodiments, and changes and modifications to the present disclosure can be made without departing from the present disclosure, and these changes and modifications fall within the scope of the present disclosure.

What is claimed is:

1. A telescopic-type horsewhip with a positionable and adjustable length, comprising: a hollow whip rod grip section, a hollow whip rod extension section, and one or more hollow whip rod sections, wherein the one or more hollow whip rod sections, which sequentially connected with each other in a socketed manner, are connected to the hollow whip rod extension section in a socketed manner, wherein one end of the hollow whip rod extension section is arranged in the hollow whip rod grip section, and the other end of the hollow whip rod extension section is connected with the hollow whip rod section; and one of a whip popper, a whip flap, a whip lash, a whip lash connector or a detachable whip drop lash fixing set is provided at an end of the hollow whip rod section;

wherein, an inner diameter of the hollow whip rod grip section is consistent in size, the hollow whip rod extension section is fixedly provided with a positioner at an end of an inner end of the hollow whip rod grip section; an outer diameter of the positioner is greater than an outer diameter of the hollow whip rod extension section and less than or equal to the inner diameter of the hollow whip rod grip section; the hollow whip rod grip section is provided with a locking bolt at a connecting part with the hollow whip rod extension section; the locking bolt is arranged at one end of the hollow whip rod grip section, and the locking bolt comprises a locking ring fixing bolt, a locking ring and a locking nut;

wherein, one end of the locking ring fixing bolt is fixedly arranged inside the hollow whip rod grip section; an inside of the other end of the locking ring fixing bolt is provided with a tongue-and-groove and connected with the locking ring; a tongue-and-groove matched with the tongue-and-groove inside the locking ring fixing bolt is provided at an outer ring of one end of the locking ring connected with the locking ring fixing bolt; the connecting part of the locking ring and the locking ring fixing bolt is provided with an adapted clamping groove, and the locking nut is connected with the locking ring fixing bolt through a threaded thread opening; an outer diameter of one end of the locking ring is adapted to an inner diameter of the end of the locking nut, and a tail cover is provided at the other end of the hollow whip rod grip section.

2. The telescopic-type horsewhip with a positionable and adjustable length according to claim 1, wherein a length dimension of the hollow whip rod extension section of the horsewhip is larger than that of the hollow whip rod grip section of the horsewhip.

3. The telescopic-type horsewhip with a positionable and adjustable length according to claim 1, wherein the hollow whip rod section is arranged in the hollow whip rod extension section, and the size of one end of the hollow whip rod section connected to the hollow whip rod extension section is larger than the size of the other end.

4. The telescopic-type horsewhip with a positionable and adjustable length according to claim 1, wherein the hollow whip rod extension section is provided with a size scale bar.

5. The telescopic-type horsewhip with a positionable and adjustable length according to claim 1, wherein the positioner provided at one end of the hollow whip rod extension section is provided with an air flow groove.

6. The telescopic-type horsewhip with a positionable and adjustable length according to claim 1, wherein the hollow whip rod grip section is provided with a collar with a non-slip handle at one end near the tail cover.

* * * * *